US006059089A

United States Patent [19]

Vidondo

[11] Patent Number: 6,059,089

[45] Date of Patent: May 9, 2000

[54] COIN DISCRIMINATOR SYSTEM

[75] Inventor: Felix Guindulain Vidondo, Peralta, Spain

[73] Assignee: Inversiones Taconera, S.L., Pamplona, Spain

[21] Appl. No.: 09/101,318

[22] PCT Filed: Nov. 4, 1997

[86] PCT No.: PCT/ES97/00264

§ 371 Date: Jul. 1, 1998

§ 102(e) Date: Jul. 1, 1998

[87] PCT Pub. No.: WO98/20464

PCT Pub. Date: May 14, 1998

[30] Foreign Application Priority Data

Nov. 5, 1996 [ES] Spain ..... 9602334

[51] Int. Cl.[7] ..... G07D 5/00

[52] U.S. Cl. ..... 194/317

[58] Field of Search ..... 194/317; 73/DIG. 4

[56] References Cited

U.S. PATENT DOCUMENTS 4,577,744 3/1986 Doucet ..... 194/335 X

FOREIGN PATENT DOCUMENTS

| | | |
|---|---|---|
| 184393 | 6/1986 | European Pat. Off. . |
| 543212 | 11/1992 | European Pat. Off. . |
| 710935 | 5/1996 | European Pat. Off. . |
| 2 236 609 | 10/1989 | United Kingdom . |
| WO 93/06569 | 4/1993 | WIPO . |

*Primary Examiner*—F. J. Bartuska
*Attorney, Agent, or Firm*—Klauber & Jackson

[57] ABSTRACT

A coin discriminator system having a massive body integrally incorporated into one of the side walls of a passage channel for coins and which projects slightly outwardly form the level of the side wall towards the passage channel. The rolling coin strikes the transducer to produce mechanical vibrations which are transformed into electrical vibrations by a transducer and an electronic device. The massive body has a curved or spherical surface in relation to the projecting section of the wall. The base of the passage channel through which the coins roll has a slant so that the coins rolling along the channel abut against the side wall of the channel in which the massive body has been positioned.

6 Claims, 2 Drawing Sheets

COIN DISCRIMINATOR SYSTEM

OBJECT OF THE INVENTION

As expressed in the title of the present specification, the following invention consists of a coin discriminating system, being of the type of systems that are built in the coin selectors to validate the coins upon the same passing through a rolling channel, accepting the validated coins as good ones and rejecting the counterfeit coins, in such a way that by means of the proposed discriminating system, discrimination of all the counterfeit coins in terms of the material and dimensions with which they have been made is sought.

Hence, the coin discriminating system is based on inclusion of the same in the through channel for all the coins through the selector, made in such a way that all the coins inserted are subjected to the system so that in terms of the material and dimensions in which they are made they are accepted or rejected, in accordance with a comparison with the parameters obtained with those stored in the memory of the electronic device that it includes, just as it is conventionally carried out.

In this way, just as it conventionally happens in the measurement of the different parameters, with other validation systems, the data obtained are compared with those stored in the memory of the system, in such a way that if the obtained parameters coincide with any of the stored ones, the coin is accepted and on the contrary, the coin is rejected.

Hence, there are different systems by means of which different parameters of the coins inserted in the selector for their validation, such as diameter, section, weight and alloy, are obtained.

FIELD OF APPLICATION

The coin discriminating system that is presented, is useful for inclusion in all types of coin selectors used in the validation of coins and that are assembled in all types of automatic vending machines, that operate by inserting coins, in recreational prize machines, and in public telephones, as well as in all those apparatus or machines that may be temporarily operated by a certain amount of money.

Hence, the coin discriminating system may be built in selectors that are particularly assembled in tobacco vending machines, in cold drink and hot drink vending machines, vending machines in general, recreational prize machines and in selectors coupled, for example, to television sets so that they operate temporarily in terms of the inserted coins.

BACKGROUND OF THE INVENTION

Given that progressively there are more and more machines and apparatus that operate automatically by means of inserting coins, there is a large number of devices and systems used to recognize inserted coins in order to prevent acceptance of counterfeit ones.

Hence, the selection or validation of coins is done by means of a selector that is assembled in relation to the coin slot. It may have other elements such as coin deposits and coin returns, in such a way that the validation of the coins is as reliable as possible, but it also happens that the way to make "counterfeit coins" is inexpensive and more and more sophisticated and therefore, validating systems must be continuously improved in order to fight against the new forms of counterfeiting.

Among the existing mechanisms for selecting and validating coins, we can cite Patent of Invention P8602773, Utility Models 283634, 291035 and 291036, as well as Patent of Invention P9002145 and its Certificate of Addition P9200624, wherein different coin selecting mechanisms are presented and described.

Patent of Invention P8602773 claims an "electronic coin selector", which is useful in those automatic vending machines, which are coin-operated, in such a way that the same is provided with a solenoid without a ferromagnetic core, creating the magnetic field in vacuo and through whose core the coins to be validated pass, disturbing the built-in oscillator, said disturbance being detected by computer means and these disturbances being different in each coin, which collaborates with the sensor to determine the alloy, being able to cover a larger number of coins selected according to their alloy.

Utility Model no. 283634 claims an "improved electronic coin selector", useful in machines and apparatus that are coin operated, which in the selection of the inserted coins carries out the comparison of the data obtained with the previously stored information, for which purpose in the path along which the coins follow in the selector, they face three sensors each one of which determines the section, diameter and alloy of the coins, these three readings being processed by a microcomputer determining the type of coin being dealt with, in such a way that if the obtained information coincides with any of the stored information the coin is accepted and on the contrary it is rejected.

Likewise, Utility Model no. 291035 claims an "electronic coin selector", which includes a sensor by which the coins pass for their verification, measuring the diameter in order to continue to pass between a hollow coil, which based on the previously measured parameter will verify the volume and alloy of the cited coin, achieving with its use greater stability in temperature variations.

Utility Model no. 291036 claims an "electronic coin selector", by means of which the coins in their passing through the inside of the selector, for their verification, pass through a hollow coil placed between two sensors that measure the section and diameter, in such a way that said hollow coil that generally has a rectangular prismatic shape, verifies the alloy and volume on the basis of the previously measured section thus achieving total reliability.

Patent of Invention P9002145 claims a "device to obtain the mechanical characteristics of coins", which includes an elastically deformable element (gage) by the effect of the weight of the coins during the passing thereof over said element, depending the formation on the weight of the coins and on the position thereof over the same, in such a way that said elastically deformable element is sensorized for the purpose of obtaining an electric signal inherent to the characteristic of the coins.

Certificate of Addition P9200624 of the above mentioned main Patent P9002145, claims some "improvements of the elastically deformable element", which remains inserted by one of its ends and has a side widening in one of its end portions, that is tightly inserted in an embedding formed in the selector, said embedding remaining retained externally by an anvil that is fixed to the selector and presses a strip towards its embedding the same moving in a cantilevered off manner.

DESCRIPTION OF THE INVENTION

The present specification describes a coin discriminating system that may be included in all types of coin selectors that are assembled in automatically coin-operated machines and apparatus, in such a way that in said selectors a slanted through channel of all the coins inserted is defined. As the coins pass through same they face the corresponding selector system to verify whether or not the coin is correct, accepting it or rejecting it in one case or the other.

The coin discriminating system is comprised of a solid body integrally inlaid in one of the walls of the coin through channel for validation thereof in the selector, in such a way that said body remains slightly projected beyond the level of the wall in which it is inlaid, a transducer that converts mechanical vibrations into electric vibrations and an electronic device.

Hence, the system is fundamentally based on the solid body integrally inlaid in one of the walls of the coin through channel for validation thereof, the same having a curved shape in relation to the projecting surface of the wall in which it is inlaid.

The cited body integrally inlaid in one of the walls of the coin through channel for validation thereof will preferably have a spherical shape, a small spherical cap projecting beyond the level of the wall, although said body may have any other shape with the condition that the surface projecting beyond the wall in which it is inlaid has a curved shape.

On the other hand, the rolling base of the coins in the through channel for validation thereof, has a slant making the coins in their rolling abut against the side wall of the through channel in which the solid body has been inlaid, causing all the coins to fall against it, in such a way that, as they do not have sharp edges but rather a smooth surface, the coins knock against it but they do not bounce but rather they follow their path along the through channel. Of course, the knocking of the coins against the solid body inlaid in the corresponding wall of the coin through channel will produce some mechanical vibrations that are transmitted in all directions.

Likewise, the system includes a transducer placed in relation to the body inlaid in the wall of the through channel, whose optimum positioning (distance and slant), makes it possible to obtain the maximum sensing of the pickup of the vibrations produced by the knocking of the coins against the solid body inlaid in the corresponding wall of the coin through channel for validation thereof.

The cited transducer will preferably remain placed close to the solid body inlaid in the wall of the coin through channel in a position opposite the position of incidence of the coins.

The coin discriminating system includes an electronic device that discriminates phase, frequency and vibration amplitude produced in the solid body inlaid in the corresponding wall of the coin through channel, upon the coins falling against it, verifying the same in terms of the material and dimensions thereof.

For this purpose and as in the case of other mechanisms, the system that includes a memory, has stored the parameters corresponding to each one of the coins to be validated, in such a way that in normal operation, the system will compare the obtained parameters with those stored in its memory accepting the coin as a good one if they correspond to each other and rejecting it on the contrary.

The present system has a reliability of practically 100%, acquiring great importance in the discrimination of high value "counterfeit coins", such as those of 500 pesetas, since, of course, acceptance of a "counterfeit coin" as an authentic one of said value implies a big loss.

In order to complete the description that is going to be made hereinafter and for the purpose of providing a better understanding of its characteristics, the present specification is accompanied by a set of drawings, in whose figures, the most significant details of the invention, described in the present specification are represented in an illustrative and non-restrictive manner.

DESCRIPTION OF A PREFERRED EMBODIMENT

Figure 1:
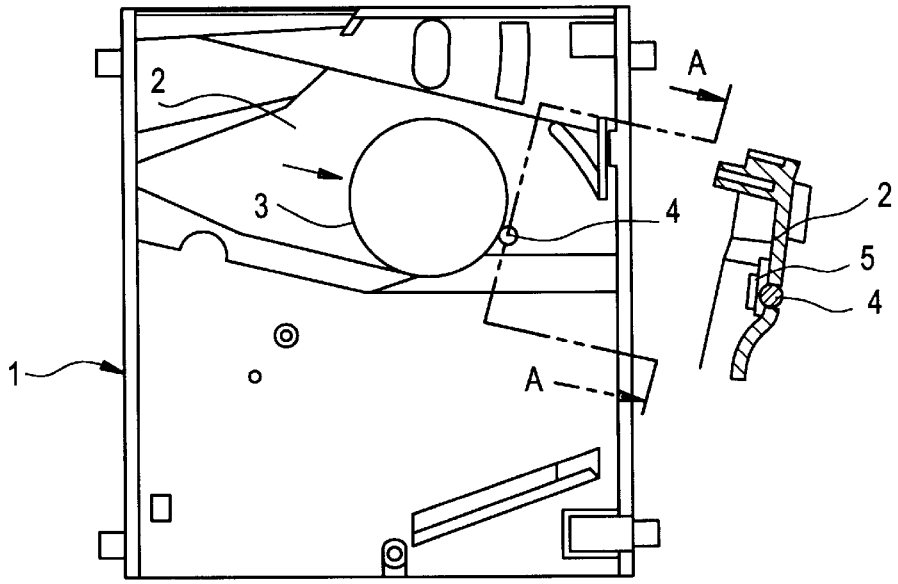
FIG. 1 is a front view of the selector, it being possible to observe how the coin that rolls along the slanted base, falls against the solid body inlaid in one of the walls of the through channel, as well as a detailed A—A section wherein one can observe the spherical body inlaid in the corresponding wall of the through channel, with the piezoelectric type transducer close to it.

In view of the commented figures and in accordance with the numbering used, we can see how in FIG. 1 of the drawings, the selector (1) is found open at its front surface of the wall (2) of the through channel through which the coins (3) roll, in which the spherical body (4) has been inlaid projecting slightly beyond the level of the wall (2) so that all the coins to be validated fall against it.

For this purpose, the coin (3) rolling base has a slight slant that causes the coins to roll abutted against wall (2) in which the spherical body (4) has been inlaid, in such a way that all the coins inevitably fall against the body (4), the latter not preventing the advance of the coins, given that the same slightly projects beyond the level of the wall (2) and it has a rounded surface.

Hence, the surface of the solid body (4), projecting beyond the wall (2), with respect to the coin (3) through channel, will always have a rounded shape, and the solid inlaid body will preferably have a spherical shape, a small spherical cap projecting beyond the level of the wall (2).

Close to the solid body (4) and in a position opposite to the position of incidence of the coins (3) to be validated against it, the system has a sensor or transducer (5) that converts the mechanical vibrations caused by the knocking of all the coins against the solid body (4) into electric vibrations.

Figure 2:
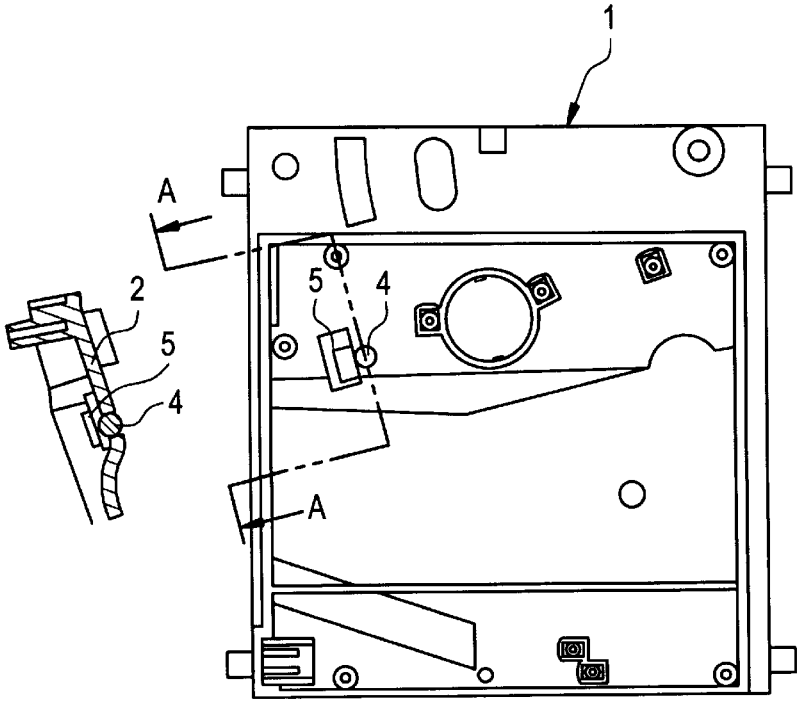
FIG. 2 shows a rear view of the selector, it being possible to see how in relation to the spherical body inlaid in the corresponding wall of the through channel there is the transducer that converts the mechanical vibrations into electric vibrations, as well as in the detailed A—A section it being possible to see the spherical body inlaid in the wall of the through channel.
Figure 3:
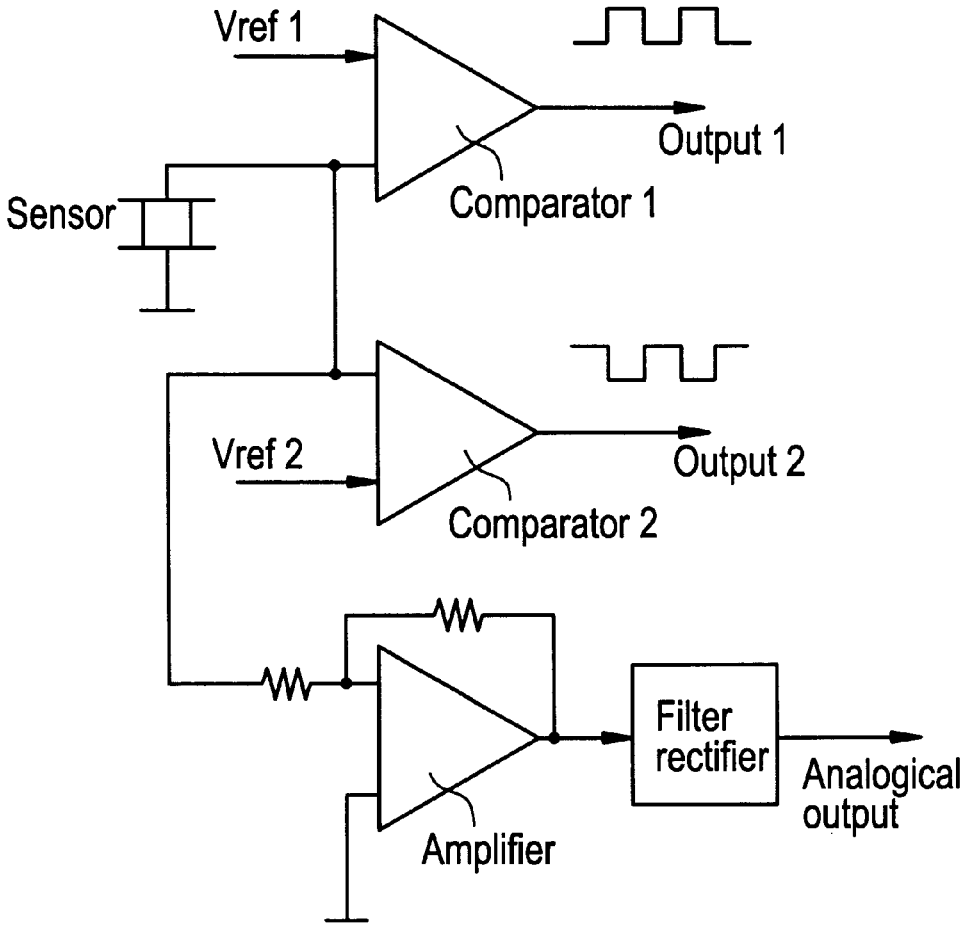
FIG. 3 shows a view of the electronic diagram that includes the coin discriminating system, wherein one can see the piezoelectric type sensor, the pair of comparators, the amplifier and the filter-rectifier.

If we see FIG. 2 of the drawings, we see how the transducer (5) remains close to the solid body (4), and opposite the surface of incidence of the coins against it, given that in said position (distance and slant), it is possible to obtain the maximum sensing of the pickup of vibrations produced by the knocking of the coins against the solid body (4) integrally inlaid in the wall (2) of the through channel of all the coins to be validated in the selector (1).

Cited FIG. 2 of the drawings represents the rear surface of the wall (2) in which the solid body (4) in which the transducer (5) remains positioned in the position that is clearly represented in the same to obtain maximum sensing, namely, close to and opposite the surface of incidence of the coins against the solid body (4), is inlaid.

The coin discriminating system includes a simple electronic device that discriminates phase, frequency and amplitude of the vibration produced in the solid body inlaid in the corresponding wall of the coin through channel, validating the same in terms of the material and dimensions thereof.

Hence, the system includes a pair of comparators connected to the sensor or piezoelectric type transducer (5), whose outputs (1) and (2) are signals indicating the frequency and frequency vibration in time, one as well as the other at different amplitude levels, according to reference values Vref1 and Vref2.

Likewise, the system may also include more reference voltages to discriminate the frequency and variation thereof in time at different amplitude levels.

On the other hand, with the amplifier that the system includes, the amplitude will be gauged and with the filter rectifier the alternation will be converted to continuous and the analogical output which is the information indicative of the vibration.

Finally and just as it conventionally happens in other coin selection systems, the system includes a memory in which the parameters corresponding to each one of the coins to be validated are stored, in such a way that in the normal operation of the selector, the system will compare the parameters obtained from the validated coins with those stored in its memory, accepting the coins as good ones if the parameters correspond to each other and rejecting them on the contrary.

With the present discriminating system, fundamentally based on the incidence of all the coins to be validated against the solid body (4) inlaid integrally in one of the walls (2) of the coin through channel, practically 100% reliability is obtained, acquiring great importance in the discrimination of "counterfeit coins" of a higher value, such as those of 500 pesetas, since, of course, acceptance of a "counterfeit coin" as an authentic one of said value, represents a great loss.

I claim:

1. Coin discriminating system, being of the type of systems that are incorporated in coin selectors to validate coins during their rolling along a through channel, accepting good ones and rejecting counterfeit ones, the system comprising:

a through channel defining a rolling track for coins (3), said through channel having a base supporting the edges of the coins during rolling of the coins along the rolling track, and side walls;

a solid body (4) integrally inlaid in one of said side walls (2) of said through channel for validation of the coins, said solid body projecting slightly into said through channel with regard to an inner surface of the side wall (2);

a transducer (5) that converts mechanical vibrations into electric vibrations;

and an electronic device;

wherein the base of the through channel has a slant making the coins rolling along said through channel abut against the side wall (2) of the through channel in which the solid body (4) has been inlaid, causing all the coins to collide with the solid body during their rolling.

2. Coin discriminating system, according to claim 1, wherein the solid body (4) has a curved surface projecting into said through channel.

3. Coin discriminating system, according to claim 2, wherein the solid body (4) has a spherical shape, a small spherical cap projecting into said through channel.

4. Coin discriminating system, according to claim 1, wherein the transducer (5) is placed in relation to the solid body (4) at an optimal distance and slant to obtain maximum sensing of pickup of mechanical vibrations caused by knocking of the coins (3) against the solid body (4), and converting said mechanical vibrations into electric vibrations.

5. Coin discriminating system, according to claim 4, wherein the transducer (5) is close to the solid body (4) in a position opposite to the position of incidence of the coins.

6. Coin discriminating system, according to claim 1, characterized in that the electronic device discriminates phase, amplitude and frequency of the vibrations produced in the solid body (4) upon the coins (3) colliding against said solid body, validating them in terms of the material and dimensions thereof.

* * * * *